US005485344A

United States Patent [19]

Matsumoto et al.

[11] Patent Number: 5,485,344

[45] Date of Patent: Jan. 16, 1996

[54] METHOD OF CONTACT-CHARGING THE SURFACE OF A PHOTOSENSITIVE MATERIAL

[75] Inventors: Shoji Matsumoto; Masanori Matsuda; Eiji Goto; Akinori Nishida; Takeshi Hori, all of Osaka, Japan

[73] Assignee: Mita Industrial Co., Ltd., Osaka, Japan

[21] Appl. No.: 126,773

[22] Filed: Sep. 27, 1993

[30] Foreign Application Priority Data

Sep. 28, 1992 [JP] Japan ..... 4-258642

[51] Int. Cl.[6] ..... G03G 15/02

[52] U.S. Cl. ..... 361/225; 355/219

[58] Field of Search ..... 355/219; 361/225, 361/221, 214

[56] References Cited

U.S. PATENT DOCUMENTS

| | | | |
|---|---|---|---|
| 3,936,174 | 2/1976 | Carpenter | 361/213 |
| 4,123,154 | 10/1978 | Fisher | 361/225 |
| 4,309,803 | 1/1982 | Blaszak | 355/219 |
| 4,380,384 | 4/1983 | Ueno et al. | 355/219 |
| 4,455,078 | 6/1984 | Mukai et al. | 361/221 |
| 4,810,432 | 3/1989 | Kisler | 361/213 |
| 4,851,960 | 7/1989 | Nakamura et al. | 361/225 |
| 4,922,299 | 5/1990 | Uchimoto et al. | 355/219 |
| 4,999,733 | 3/1991 | Kakuda | 361/213 |
| 5,008,706 | 4/1991 | Ohmori et al. | 361/225 |
| 5,089,851 | 2/1992 | Tanaka et al. | 361/225 |
| 5,095,335 | 3/1992 | Watanabe et al. | 355/219 |
| 5,126,913 | 6/1992 | Araya et al. | 361/225 |
| 5,144,368 | 9/1992 | Ohzeki et al. | 355/219 |
| 5,146,280 | 9/1992 | Kisu | 355/219 |
| 5,177,534 | 1/1993 | Kisu et al. | 355/219 |
| 5,196,892 | 3/1993 | Mitsuaki | 355/219 |
| 5,243,387 | 9/1993 | Ikegawa | 361/225 |
| 5,321,471 | 6/1994 | Ito et al. | 355/219 |
| 5,357,323 | 10/1994 | Haneda et al. | 355/219 |
| 5,367,364 | 11/1994 | Michlin et al. | 355/219 |
| 5,367,365 | 11/1994 | Haneda et al. | 355/219 |
| 5,384,626 | 1/1995 | Kugoh et al. | 361/225 |

FOREIGN PATENT DOCUMENTS

| | | |
|---|---|---|
| 0308185 | 3/1989 | European Pat. Off. . |
| 0329366 | 8/1989 | European Pat. Off. . |
| 0504877 | 9/1992 | European Pat. Off. . |
| 60-220588 | 11/1955 | Japan . |
| 1191161 | 8/1989 | Japan . |
| 3203754 | 9/1991 | Japan . |
| 5746265 | 3/1992 | Japan . |
| 5273844 | 10/1993 | Japan . |

OTHER PUBLICATIONS

Patent Abstracts of Japan, vol. 13, No. 1, (P–808) (3349), 1989.

*Primary Examiner*—Jeffrey A. Gaffin
*Attorney, Agent, or Firm*—Sherman and Shalloway

[57] ABSTRACT

A charging method for charging a photosensitive material of, for example, the photosensitive drum of an electrophotographic copying apparatus is accomplished by bringing an endless electrically conducting flexible sheet containing a brush roller into physical contact with the surface of the photosensitive material and applying a voltage to the electrically conducting flexible sheet. The electrically conducting flexible sheet is a laminate of a first resistance layer positioned on the side of the brush roller and a second resistance layer positioned on the outer surface of the first resistance layer. The second resistance layer has an electric resistance greater than that of the first resistance layer. The method using the laminated flexible sheet makes it possible to uniformly and stably charge the surface of the photosensitive material without the life of the photosensitive material being deteriorated and without permitting the output of the power source to drop even when defects, such as pinholes, exist in the surface of the photosensitive material.

10 Claims, 4 Drawing Sheets

METHOD OF CONTACT-CHARGING THE SURFACE OF A PHOTOSENSITIVE MATERIAL

BACKGROUND OF THE INVENTION

1. Field of the Invention

The present invention relates to a charging method which is capable of primarily charging the surface of a photosensitive material without relying upon the corona discharge.

2. Description of the Prior Art

According to an image-forming method based upon the electrophotographic method, an image is formed by uniformly charging the surface of a photosensitive material, exposing the surface of the photosensitive material to the image-bearing light to form an electrostatic latent image that corresponds to the image of the document, and developing and transferring the thus formed electrostatic latent image.

In the above image-forming method, the surface of the photosensitive material has generally been charged (primarily charging) by the corona discharge, generating, however, ozone which is hazardous to the environment. In order to prevent the generation of ozone, in recent years, there have been proposed methods of primarily charging the surface of a photosensitive material by bringing a charging conducting rubber roller into frictional contact with the surface of the photosensitive material while applying a bias voltage (Japanese Laid-Open Patent Publications Nos. 149669/1988 and 267667/1989).

However, the above-mentioned charging methods relying upon the frictional contact have a problem in that uniformity of the electric charge is lost when contaminations such as dust, paper powder, etc. are clogged between the electrically conducting rubber roller and the photosensitive material, making it difficult to stably continue charging. Moreover, in case the surface of the photosensitive material is poorly cleaned and toner is left on the surface, the residual toner adheres on the surface of the photosensitive material at the time of forming image causing the photosensitive material to lose durability. In order to accomplish uniform charging, furthermore, the application of a DC bias voltage only is not sufficient and an AC bias voltage must be applied as well.

In order to solve the above-mentioned problems, the present applicant has previously proposed a method of effecting frictional-charging by using an electrically conducting brush roller to bring a flexible and electrically conducting sheet into frictional contact with the surface of the photosensitive material while applying a DC voltage to the roller (Japanese Patent Application No. 68148/1992).

According to this charging method, the flexible and electrically conducting sheet is depressed by the electrically conducting brush roller and is brought into intimate contact with the surface of the photosensitive material, giving a great advantage in that the frictional-charge can be uniformly carried out by the application of a low DC bias voltage only without the need of applying an AC bias voltage. In case defects such as pinholes exist in the surface of the photosensitive material, however, the above charging method permits the electrically conducting sheet to come in contact with the pinholes. Therefore, a large current flows into the pinholes and the output of the power source drops, resulting in poor charging.

SUMMARY OF THE INVENTION

The assignment of the present invention therefore is to provide a charging method which does not permit the output of the power source to drop even when there exist defects such as pinholes in the surface of the photosensitive material and which makes it possible to accomplish the charging uniformly and efficiently.

According to the present invention, there is provided a method of contact-charging the surface of a photosensitive material by bringing an endless electrically conducting flexible sheet containing a brush roller into physical contact with the surface of a photosensitive material and applying a voltage to said electrically conducting flexible sheet, wherein said electrically conducting flexible sheet comprises a first resistance layer positioned on the side of the brush roller and a second resistance layer positioned on the outer surface, the second resistance layer having an electric resistance greater than that of the first resistance layer.

That is, according to the present invention, the electrically conducting flexible sheet comprises a first resistance layer having a small resistance and a second resistance layer having a large resistance which is interposed between the first resistance layer and the surface of the photosensitive material. Therefore, even in case defects such as pinholes exist in the surface of the photosensitive material, the defective portions are prevented from coming into direct contact with the first resistance layer of a small resistance. Therefore, a heavy current due to electric leakage is prevented from flowing and, as a result, the voltage of the output power source is effectively avoided from dropping. It is thus made possible to prevent the occurrence of defective charging.

Furthermore, the electrically conducting flexible sheet is brought into forced contact with the surface of the photosensitive material by the brush roller and, hence, intimate adhesion (contact) to the surface of the photosensitive material is effectively maintained even in case contaminations such as dust, paper powder, etc. are clogged between them since the flexible sheet undergoes the deflection. Accordingly, the charging is carried out effectively and uniformly without the need of applying an AC bias voltage in addition to a DC bias voltage.

Moreover, since the flexible sheet and the surface of the photosensitive material are contacting to each other very softly being urged by the brush roller, the toner that happens to exist on the surface of the photosensitive material does not adhere to the surface thereof. As a result, charging is stably carried out without causing the photosensitive material to lose its durability.

DESCRIPTION OF THE PREFERRED EMBODIMENTS

The invention will now be described in detail with reference to an embodiment in conjunction with the accompanying drawings.

Figure 1:
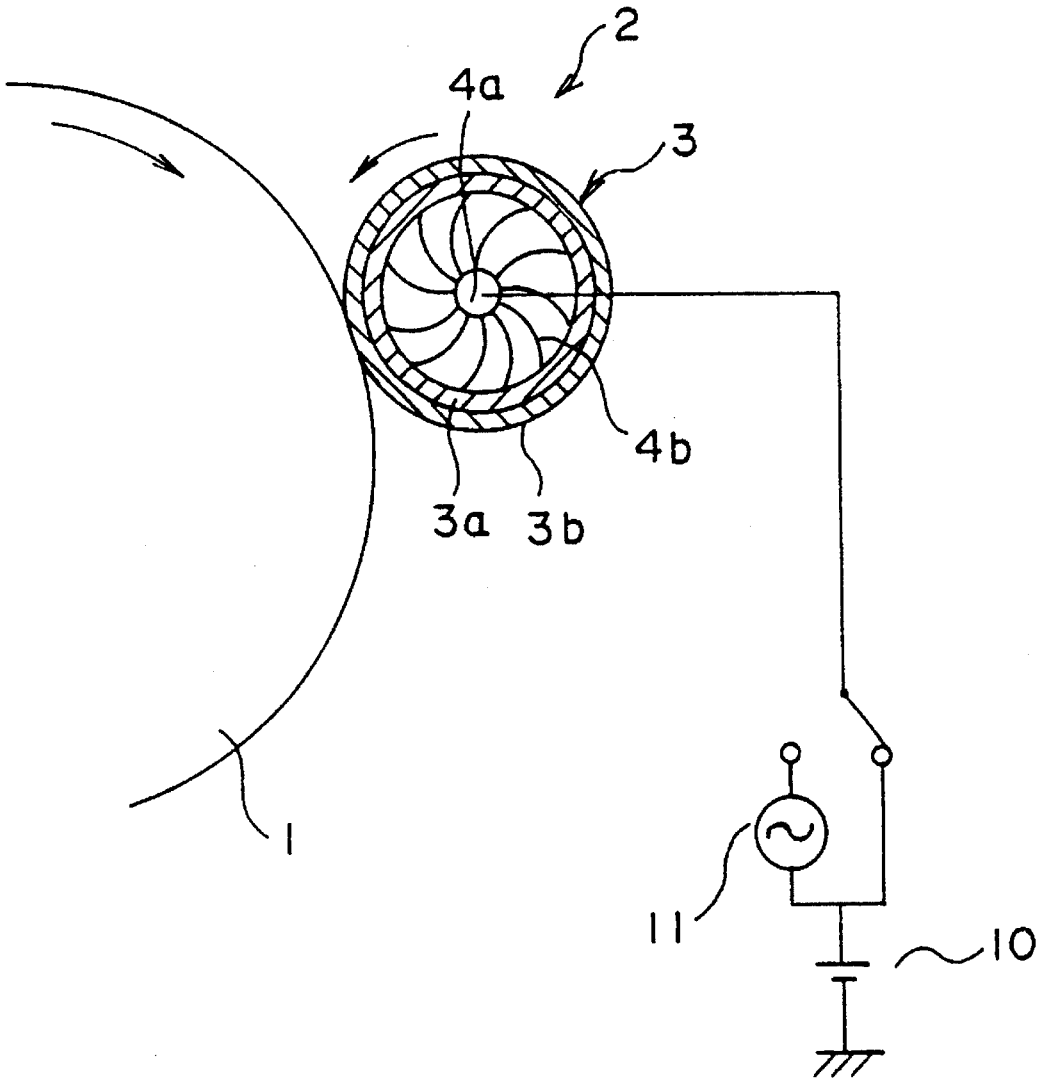
FIG. 1 is a diagram illustrating a charging method according to the present invention.
Figure 2:
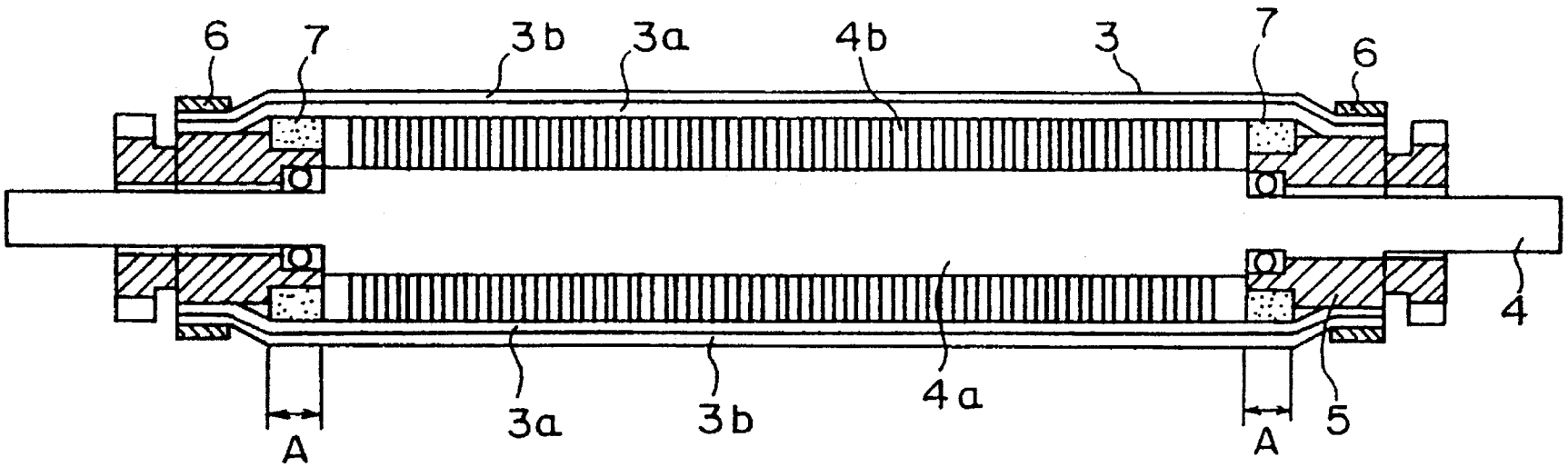
FIG. 2 is a side view of a charging roller employed in the charging method of FIG. 1.

FIG. 1 is a diagram for explaining the contact-charging method of the present invention, and FIG. 2 is a side sectional view of a contact-charging roller that is used for the contact-charging of FIG. 1.

According to the method of the present invention as will be obvious particularly from FIG. 1, a contact-charging roller 2 is disposed in a manner to come in contact with the surface of a photosensitive drum 1 that is rotatably provided.

The contact-charging roller 2 comprises a flexible laminated sheet 3 of the form of a seamless tube and a brush roller 4 embedded therein. The brush roller 4 is constituted by an electrically conducting roller 4*a* and a brush 4*b* studded thereon. Both ends of the flexible laminated sheet 3 are secured to flange rings 5 provided for the electrically conducting roller 4*a*. That is, the flange rings 5 are secured to the electrically conducting roller 4*a* as a unitary structure, so that the flexible laminated sheet 3 can be rotated together with the brush roller 4 at the same speed. If the flange rings 5 and the electrically conducting rollers 4*a* are so constituted as to rotate independently of each other, then a suitable drive transmission mechanism such as gears can be coupled to the flanges 5, so that the laminated sheet 3 is rotated independently of the brush roller 4 or, so that, for example, the brush roller 4 rotates in a direction opposite to the direction in which the laminated sheet 3 moves.

Generally speaking, it is desired that the moving speed of the laminated sheet 3 is different from the moving speed of the brush roller 4 in order to prevent the laminated sheet 3 from being deformed such as from being twisted. When they move in the same direction, it is desired that the moving speed of the brush roller 4 (brush 4*b*) is set to be from 1.1 to 5 times as fast as the moving speed of the laminated sheet 3. When they move in the opposite directions, it is desired that the moving speed of the brush 4*b* is set to be from 1.1 to 3 times as fast as the moving speed of the laminated sheet 3.

The flexible laminated sheet 3 may be secured to the flange rings 5 by using a suitable heat-shrinking resin ring 6 in a manner of holding the end of the flexible laminated sheet 3 between the ring 6 and the flange ring 5, or by using a suitable adhesive agent.

As shown in FIG. 2, furthermore, it is desired that an elastic ring 7 such as a silicone rubber ring is provided at the inside end portion of the flange ring 5, and the end of the flexible laminated sheet 3 is secured to the flange ring 5 so as to be intimately adhered to the resilient ring 7. Therefore, with a suitable tension being imparted, the flexible laminated sheet 3 is effectively prevented from being twisted at the time when the sheet 3 is brought into physical contact with the surface of the photosensitive drum 1. Moreover, there is no need of creating a difference in the speed between the laminated sheet 3 and the brush 4*b*, and no drive mechanism for creating a difference in the speed is needed. It is therefore allowed to realize a developing device in a compact size.

In this case, the sheet 3 comes into intimate contact with the end of the photosensitive drum over the upper surface area A of the laminated sheet 3 that corresponds to the elastic ring 7, and rotates following the turn of the photosensitive drum 1. Therefore, no particular drive mechanism needs be provided to rotate the laminated sheet 3. Moreover, it is desired that the elastic ring 7 has such a size that the width of contact between the laminated sheet 3 and the surface of the photosensitive drum 1 is usually from about 2 to 10 mm.

In the present invention, the flexible laminated sheet 3 is constituted by a first resistance layer having a small electric resistance (hereinafter referred to as low-resistance layer) 3*a* and a second resistance layer having an electric resistance larger than that of the layer 3*a* (hereinafter referred to as high-resistance layer) 3*b* which is located on the side of the photosensitive drum in order to prevent the low-resistance layer 3*a* from coming into contact with the photosensitive drum 1.

It is desired that the low-resistance layer 3*a* has a volume resistivity of not greater than $10^7$ Ω.cm and, particularly, within a range of from $10^6$ to 10 Ω .cm. That is, when the volume resistivity is greater than the above range, it becomes difficult to uniformly and effectively charge the surface of the photosensitive material. It is desired that the high-resistance layer 3*b* has a volume resistivity of generally not smaller than $10^8$ Ω.cm and, particularly, within a range of from $10^9$ to $10^{12}$ Ω.cm, most particularly from $10^9$ to $10^{11}$ Ω.cm though it may vary depending upon the volume resistivity of the low-resistance layer 3*a*. When the volume resistivity is smaller than this range, it is difficult to prevent the flow of a large current caused by the leakage to the surface of the photosensitive material 1 through the defective portion. When the volume resistivity is greater than $10^{12}$ Ω.cm, on the other hand, it becomes difficult to efficiently contact-electrify the surface of the photosensitive material 1.

In the present invention, any material can be used as the low-resistance layer 3*a* and as the high-resistance layer 3*b* provided it has predetermined electrically conducting properties and flexibility. In general, there can be used a resin or a rubber blended with a variety of electrically conducting agents.

Examples of such a resin include a variety of types of thermoplastic elastomers such as a polyester elastomer, a polyamide elastomer, a polyurethane elastomer, a soft vinyl chloride resin, a styrene-butadiene-styrene block copolymer elastomer, an acryl elastomer as well as a nylon 6, a nylon 6,6, a nylon 6-nylon 66 copolymer, a nylon 6,6-nylon 6,10 copolymer, and a polyamide or a copolyamide like an alkoxymethylated nylon such as a methoxymethylated nylon and the like, and modified products thereof, and a silicone resin, an acetal resin such as a polyvinyl butyral, a polyvinyl acetate, an ethylene-vinyl acetate copolymer, an ionomer and the like. Examples of the rubber include a natural rubber, a butadiene rubber, a styrene rubber, a butadienestyrene rubber, a nitrile-butadiene rubber, an ethylene-propylene copolymer rubber, an ethylene-propylene-nonconjugated diene copolymer rubber, a chloroprene rubber, a butyl rubber, a silicone rubber, an urethane rubber, an acrylic rubber and the like.

As the low-resistance layer 3*a*, there can be used, for example, a seamless metal foil which may be nickel, aluminum, copper, brass, tin, or the like and is obtained by the electroforming method or the extrusion.

In addition to the above-mentioned examples, suitable examples of the resin or the rubber for the high-resistance layer 3*b* may, particularly, be a fluorine-containing resin or rubber such as a vinylidene polyfluoride (PVDF), a polytetrafluoroethylene (PTFE), a tetrafluoroethylene-hexafluoropropylene copolymer (PTFE HFP), a perfluoroalkoxy-type fluorine-containing resin and the like. Use of these resins or rubbers which are inert and having a small coefficient of friction as the high-resistance layer 3*b* gives a great advantage from the standpoint of life of the photosensitive material and life of the sheet.

Examples of the electrically conducting agent that is blended in the resin or the rubber to adjust the volume resistivities of the layers 3*a* and 3*b* include an electrically conducting carbon black, a metal powder such as of silver, gold, copper, brass, nickel, aluminum, stainless steel and the like, a powdery electrically conducting agent such as a tin oxide-type electrically conducting agent, as well as non-ionic, anionic, cationic, and amphoteric organic electrically conducting agents and organotin-type electrically conducting agents. In general, a higher conduction is obtained when a chain structure is formed by the particles of the conducting agent in the resin or the rubber. In this case, however, dot-like high potential portions are generated by the application of a voltage causing the charging to take place nonuniformly. Therefore, the electrically conducting agent should be uniformly and finely dispersed in the resin or in the rubber. For this purpose, it is important that the resin or the rubber blended with the electrically conducting agent is kneaded to a sufficient degree. In order to uniformly and effectively disperse the electrically conducting agent, furthermore, it is helpful to use an acid-modified resin or rubber which is copolymerized with an ethylenically unsaturated carboxylic acid such as acrylic acid, methacrylic acid, or maleic anhydride as part of the resin or the rubber.

The laminated sheet 3 can be easily formed by the integral molding such as simultaneous lamination extrusion or coating. In this case, the resin or the rubber for forming the low-resistance layer 3*a* and the high-resistance layer 3*b* should be selected from those that have melting points or softening points within a narrow range from the standpoint of increasing the adhesion strength between the two layers.

Generally speaking, the low-resistance layer 3*a* should have a thickness of from 50 to 400 μm, particularly from 100 to 300 μm and the high-resistance layer 3*b* should have a thickness of from 15 to 100 μm, particularly from 20 to 60 μm though they may vary depending upon their softness. Furthermore, the surface of the laminated sheet 3 and, particularly, the surface of the high-resistance layer 3*b* should be as smooth as possible with its average coarseness being not greater than 5 μm and particularly not greater than 1 μm as measured in compliance with JIS B 0601.

According to the present invention, the brush roller 4 preferably consists of studding on the electrically conducting roller 4*a* the brush 4*b* or the insulating or electrically conducting organic or inorganic fiber.

When the electrically conducting fiber is used as the brush 4*b*, an insulating resin ring is used as the flange ring 5, and the voltage is applied to the laminated sheet 3 via the electrically conducting roller 4*a* and the brush 4*b*.

It is desired that the electrically conducting brush has a volume resistivity of from $10^2$ to $10^8$ Ω.cm and, particularly, from $10^3$ to $10^6$ Ω.cm. The brush fiber should have a thickness of from 2 to 10 deniers (d) and, particularly, from 3 to 6 d, and the fiber length (hair length) of from 2 to 7 mm and, particularly, from 3 to 5 mm. Furthermore, the hair density should be from 10,000 to 200,000 hairs/sq. in. and, particularly, from 30,000 to 100,000 hairs/sq. in. from the standpoint of imparting smooth and uniform pressing force. Moreover, the tips of the brush should be rounded from the standpoint of suppressing the laminated sheet 3 from being worn out.

The organic electrically conducting fiber will be a synthetic or a regenerated fiber in which the particles of an electrically conducting agent are dispersed, such as a polyamide fiber, e.g., nylon 6 or nylon 6,6, a polyester fiber, e.g., a polyethylene terephthalate, or an acrylic fiber, a polyvinyl alcohol fiber, a polyvinyl chloride fiber, rayon, acetate, or the like. The electrically conducting property can be imparted to the fiber not only by the method of blending the electrically conducting agent but also by the method of metallizing the surfaces of the fiber. The electrically conducting agent may be the one mentioned above. A suitable example of the electrically conducting inorganic fiber may be a metal fiber such as of a stainless steel or brass, in addition to the carbon fiber.

When an insulating fiber is used as the brush 4*b*, a metallic electrically conducting ring is used as the flange ring 5, and the voltage is applied to the laminated sheet 3 via the electrically conducting roller 4*a* and the flange ring 5. When the brush 4*b* is electrically conducting, in general, the photosensitive drum 1 having any defect such as pinholes in the surface thereof permits a local current to flow into the defective portion from the tips of the brush 4*b*. Therefore, the tips of the brush tends to be damaged. In an embodiment in which the brush 4*b* has electrically insulating property, on the other hand, the electric current flows from the laminated sheet 3 and no local current flows presenting a great advantage in that the above-mentioned trouble does not at all take place.

As the insulating fiber, the above-mentioned organic fiber can be used but without being blended with the electrically conducting agent, the denier and the fiber length thereof being within the aforementioned ranges. Here, however, the hair density should be from 30,000 to 100,000 hairs/sq. in. and, particularly, from 40,000 to 90,000 hairs/sq. in.

According to the present invention as shown, particularly, in FIG. 1, a DC power source 10 is connected via a switch to the electrically conducting roller 4*a*, the laminated sheet 3 is pushed by the brush roller 4 to come into contact with the surface of the photosensitive drum 1 that is rotating while applying a voltage to the flexible laminated sheet 3 via the brush 4*b* or the flange ring 5, in order to charge the surface of the photosensitive drum 1.

The contact-charging roller 2 is disposed in an electrophotographic apparatus being held, for example, in a box of which the one surface is open, and is pressed by a suitable spring, so that the laminated sheet 3 comes in contact with the surface of the photosensitive drum 1 via the opening under the application of a predetermined pressure maintaining a predetermined width of contact.

Figure 3:
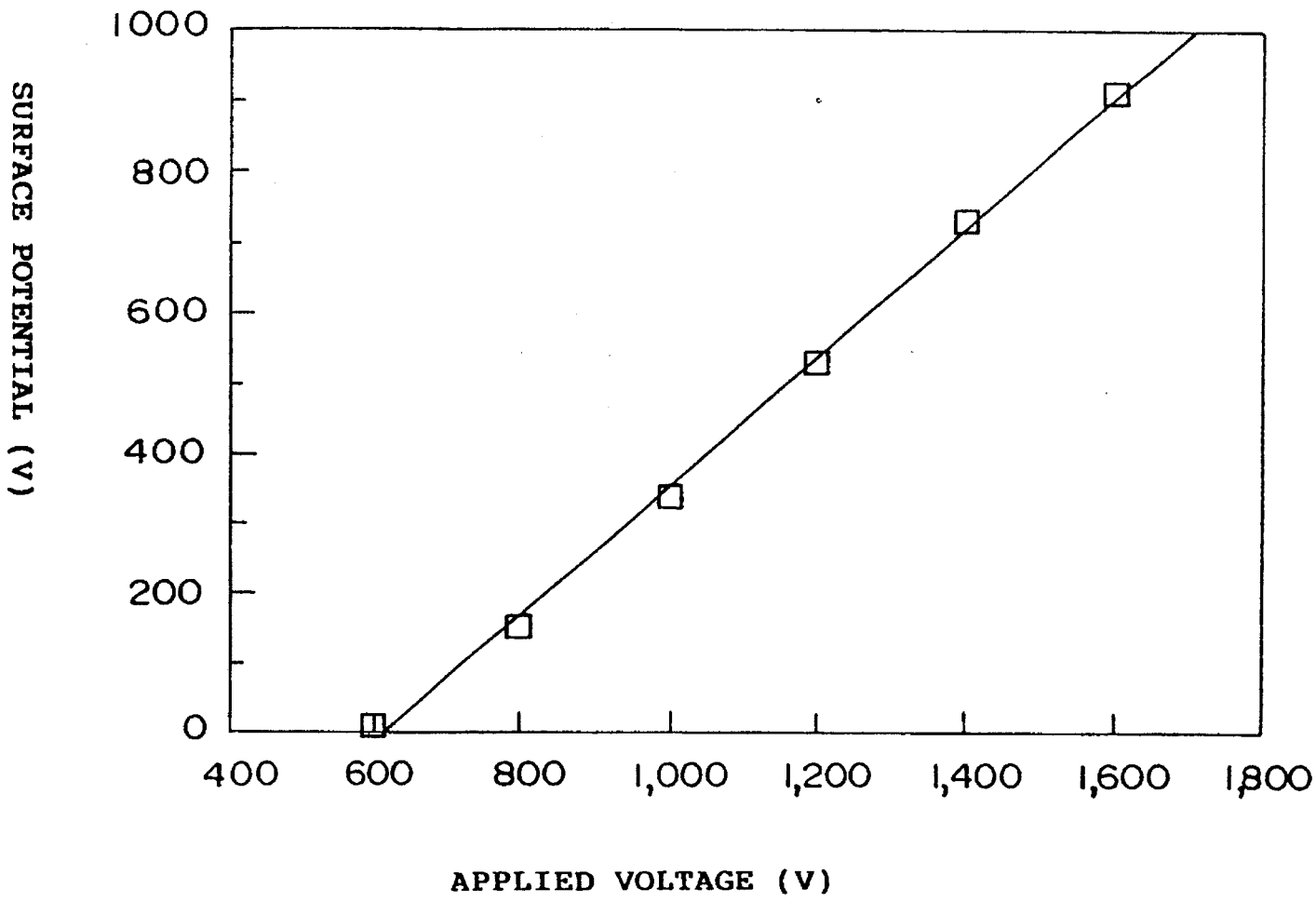
FIG. 3 is a diagram illustrating a relationship between the applied voltage and the surface potential of the photosensitive material when the charging method of the present invention is applied to an organic photosensitive material.

It is desired that the charging voltage applied to the laminated sheet 3 is set to be from 1.5 to 3.5 times and, particularly, from 2 to 3 times as great as the charging start voltage on the surface of the photosensitive drum 1. FIG. 3 is a diagram illustrating a relationship between the voltage applied to the electrically conducting laminated sheet 3 and the surface potential of the photosensitive drum 1 when the charging method of the present invention is adapted by using the organic photosensitive material. It will be understood from this drawing that a favorable linear relationship is maintained between the applied voltage and the surface potential over the effective charging region. With the charging method of the present invention, therefore, it is made possible to constantly maintain the surface potential of the photosensitive material at an optimum value by, for example, arranging a surface potential sensor in the periphery of the photosensitive material and by increasing or decreasing the applied voltage based on the surface potential detected by the sensor.

According to the present invention, the high-resistance layer 3*b* is in contact with the surface of the photosensitive drum 1 at the time when the voltage is applied and a large current is prevented from flowing even when defects such as pinholes exist in the surface of the photosensitive drum 1, enabling the surface of the photosensitive drum 1 to be uniformly and efficiently charged which is a great advantage. Another advantage of the present invention is that the charge is carried out uniformly and homogeneously by using a DC voltage only. In order to effect the charging which is more free from unevenness, it is allowable to apply a voltage by combining the DC power source 10 with an AC power source 11 in order to superpose an AC voltage to the DC voltage. This may be accomplished by throwing the switch shown in FIG. 1 from the right contact point connecting directly to DC power source 10 to left contact point connecting to DC power source 10 via AC power source 11. It is desired that such an AC voltage has a frequency of from 300 to 1500 Hz and, particularly, from 400 to 1000 Hz, and an interpeak voltage which is 2.5 to 4 times as great and, particularly, 2.8 to 3.5 times as great as the above-mentioned DC voltage.

Figure 4:
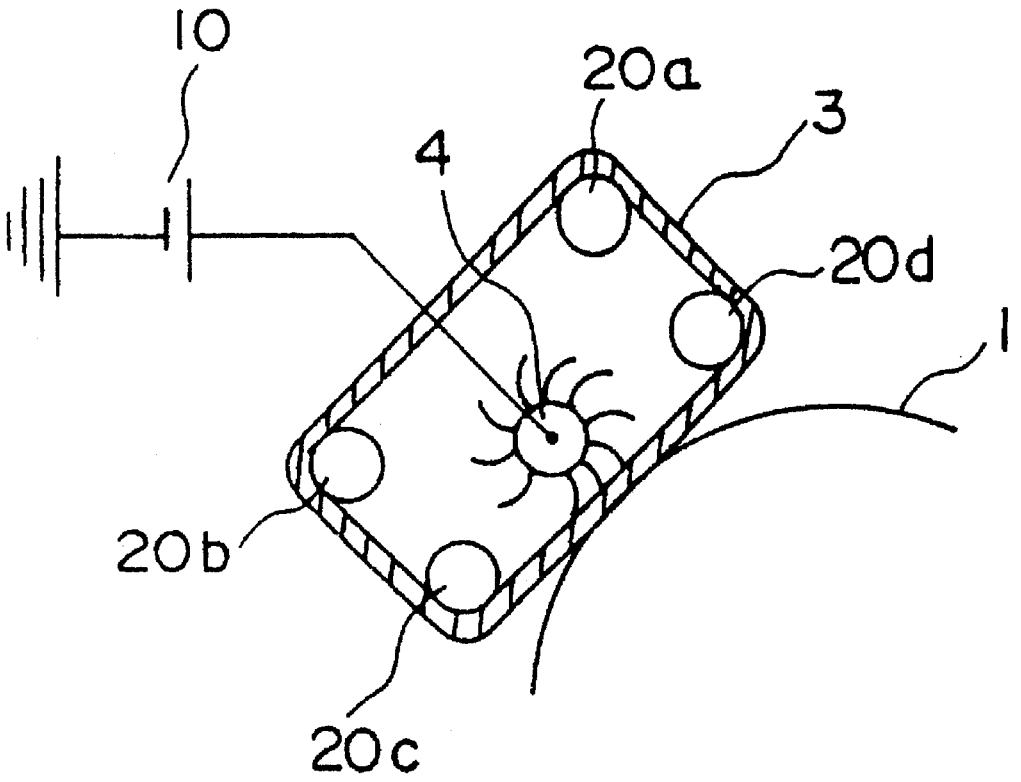
FIG. 4 is a diagram illustrating an embodiment of carrying out the charging method of the invention by providing a flexible electrically conducting laminated sheet in the form a belt.

The embodiment shown in FIG. 1 has the flexible electrically conducting laminated sheet 3 in the form of a tube. As shown in FIG. 4, however, it is also allowable to use the laminated sheet 3 in the form of a belt that is endlessly wrapped around the drive or driven rollers 20*a*, 20*b*, 20*c* and 20*d* while providing the electrically conducting brush roller 4 on the inside thereof. Even in this case, the uniform-charge can be accomplished in the same manner by maintaining constant the width of contact between the belt-like laminated sheet 3 and the photosensitive drum 1 by utilizing the same pushing force as that of FIG. 1.

The charging method of the present invention is effective in charging the photosensitive material used in a variety of electrophotographic methods such as in a copying machine, facsimile, laser printer and the like, and can be adapted to charging any photosensitive materials of a single layer or a laminated layer structure, such as an a-Si photosensitive material, a selenium photosensitive material, and a single-layer or a multi-layer organic photosensitive material. Among them, the charging method of the present invention can be adapted to the organic photosensitive material without generating ozone or $NO_x$ and, hence, without deteriorating the electric charge-generating pigment, electric charge transporting substance, binder, dielectric and the like which constitute the photosensitive material, enabling the life thereof to be extended. The charging method of the present invention is not limited to the charging of a narrow sense but can also be adapted to the discharge by applying a bias voltage, as a matter of course.

Example 1

The charging apparatus of FIG. 1 was mounted on a modified electrophotocopying machine DC-2566 manufactured by Mira Industrial Co., Ltd. that employed an organic photosensitive material. The charging, exposure to light, developing, transfer and fixing were carried out without applying an AC voltage.

Properties and charging conditions of the members of the charging apparatus were set as described below. Volume resistivities of the resistance layers constituting the endless flexible electrically conducting sheet were measured by using a volume resistivity tester LORESTER or HIRESTER manufactured by Mitsubishi Yuka Co. while applying a voltage of 10 V. Endless flexible electrically conducting sheet (two-layer constitution):

High-resistance layer (surface layer): Vinyledene polyfluoride

-continued (thickness: 0.04 mm, volume resistivity: $1.4 \times 10^8$ Ω. cm)
Low-resistance layer (brush roller side): Polyvinyl chloride elastomer (thickness: 0.2 mm, volume resistivity: $8.8 \times 10^2$ Ω. cm)
Inner diameter of roller (inner diameter of endless sheet): 20 mm
Brush roller:

Material: Electrically insulating rayon
Outer diameter: 19.8 mm
Thickness of fiber: 6 deniers
Length of fiber: 3 mm
Hair density: 86,000 hairs/sq. in.
Charging conditions:

| | |
|---|---|
| Applied DC voltage: | +1600 V (charge start voltage: +600 V) |
| Number of revolutions of brush roller: | 150 rpm (rotated following photosensitive material) |
| Number of revolutions of endless sheet: | 150 rpm fixed to brush roller and rotated following photosensitive material) |
| Peripheral speed of photosensitive material: | 157 mm/sec. |

After the charging was carried out under the above-mentioned conditions, the surface potential of the photosensitive material was +800 V, and the obtained copy exhibited a favorable image without black-dotted shades.

The charging was also carried out under the same conditions using a photosensitive material having pinholes. However, there did not at all develop any image defect such as white streaks caused by the concentrated leakage of charging current that flows into the pinholes.

Example 2

The experiment was carried out quite in the same manner as in Example 1 but changing the members constituting the charging apparatus and the charge conditions as follows:

| | |
|---|---|
| High-resistance layer (surface layer): | Fluorine-containing rubber (thickness: 0.03 mm, volume resistivity: $2.8 \times 10^{10}$ Ω. cm) |
| Low-resistance layer (brush roller side): | Polyurethane-type elastomer (thickness: 0.3 mm, volume resistivity: $2.4 \times 10^8$ Ω. cm) |
| Inner diameter of roller (inner diameter of endless sheet): | 20 mm |
| Brush roller: | |
| Material: | Electrically conducting rayon (volume resistivity: $1.0 \times 10^3$ Ω. cm) |
| Outer diameter: | 19.8 mm |
| Thickness of fiber: | 6 deniers |
| Length of fiber: | 3 mm |
| Hair density: | 100,000 hairs/sq. in. |
| Charging conditions: | |
| Applied DC voltage: | +1700 V (charging start voltage: +600 V) |

Number of revolutions of brush roller: 225 rpm (rotated in the same direction as the endless sheet)
Number of revolutions of the endless sheet: 150 rpm (rotated following the photosensitive material)
Peripheral speed of photosensitive material: 157 mm/sec.

After the charging was carried out under the above-mentioned conditions, the surface potential of the photosensitive material was +790 V, and the obtained copy exhibited a good image without black-dotted shades like in Example 1.

Even when the experiment was carried out using a photosensitive material having pinholes, there did not at all develop image defects such as white streaks caused by the concentrated leakage of charging current that flows into the pinholes.

Comparative Example 1

Experiment was carried out quite in the same manner as in Example 1 but changing the members constituting the charging apparatus and the charging conditions as follows:
Endless flexible electrically conducting sheet (two-layer constitution):

The layer constitution of the sheet used in Example 1 was reversed. That is, the low-resistance layer was used as the surface layer, and the high-resistance layer was located on the side of the brush roller.

Brush roller:

The brush roller was quite the same as the one used in Example 1.

| Charging conditions: |
|---|
| Applied dc voltage: +1620 V (charging start voltage: +600 V) |
| Number of revolutions of brush roller: 150 rpm |
| (rotated following the photosensitive material) |
| Number of revolutions of endless sheet: 150 |
| rpm (fixed to brush roller and rotated |
| following the photosensitive material) |
| Peripheral speed of photosensitive material: 157 mm/sec. |

After the charging was carried out under the above-mentioned conditions, the surface potential of the photosensitive material was +790 V, and the obtained copy exhibited an image with black-dotted shades.

When the experiment was carried out using a photosensitive material having pinholes, there developed image defects such as white streaks due to the concentrated leakage of charging current that flowed into the pinhole portion.

Comparative Example 2

The experiment was carried out quite in the same manner as in Example 1 but changing the members constituting the charging apparatus and the charging conditions as follows:
Endless flexible electrically conducting sheet (single-layer constitution):

Material: Polyvinyl chloride elastomer (thickness: 0.3 mm, volume resistivity: $5.2\times10^2$ Ω.cm)

Inner diameter of roller (inner diameter of endless sheet): 20 mm

Brush roller:

The brush roller was quite the same as the one used in Example 2.

| |
|---|
| Applied DC voltage: +1600 V (charging start voltage: +600 V) |
| Number of revolutions of brush roller: 225 rpm |
| (rotated in the same direction as the endless sheet) |
| Number of revolutions of endless sheet: 150 rpm |
| (rotated following the photosensitive material) |
| Peripheral speed of the photosensitive material: 157 mm/sec. |

After the charging was carried out under the above-mentioned conditions, the surface potential of the photosensitive material was +800 V, and the obtained copy exhibited an image with black-dotted shades.

In the experiment using a photosensitive material with pinholes, there developed image defects such as white streaks due to the concentrated leakage of charging current that flowed into the pinholes.

The present invention makes it possible to uniformly and stably electrify the surface of the photosensitive material without deteriorating the life of the photosensitive material and without permitting the output of the power source to drop even when defects such as pinholes exist in the surface of the photosensitive material.

We claim:

1. In a method of contact-charging the surface of a photosensitive material by bringing an endless electrically conducting flexible sheet containing a brush roller into physical contact with the surface of the photosensitive material and applying a voltage to said electrically conducting flexible sheet, the improvement comprising using as said electricity conducting flexible sheet a laminated flexible sheet which comprises a first resistance layer positioned on the side of the brush roller and a second resistance layer laminated on the outer surface of the first resistance layer such that the second resistance layer is interposed between the first resistance layer and the surface of the photosensitive material, and the second resistance layer having an electric resistance greater than that of the first resistance layer.

2. A method of contact-charging the surface of a photosensitive material according to claim 1, wherein the volume resistivity of said first resistance layer not greater than $10^7$ Ω.cm, and the volume resistivity of said second resistance layer is not smaller than $10^8$ Ω.cm.

3. A method of contact-charging the surface of a photosensitive material according to claim 1, which further comprises using as said brush roller an insulating brush which is studded on an electrically conducting roller.

4. A method of contact-charging the surface of a photosensitive material according to claim 3, which further comprises securing said endless electrically conducting laminated flexible sheet to electrically conducting flange rings provided on the rotary shaft of said electrically conducting roller, and applying a voltage to said electrically conducting roller, whereby a voltage is applied to the endless electrically, conducting flexible laminated sheet via the flange rings.

5. A method of contact-charging the surface of a photosensitive material according to claim 1, which further comprises using as said brush roller an electrically conducting brush which is studded on an electrically conducting roller.

6. A method of contact-charging the surface of a photosensitive material according to claim 5, which further comprises securing said endless electrically conducting laminated flexible sheet to electrically insulating flange rings provided on the rotary shaft of said electrically conducting roller, and applying a voltage to said electrically conducting roller, whereby a voltage is applied to the endless electrically conducting laminated flexible sheet via the electrically conducting brush.

7. The method of claim 1 wherein the volume resistivity of said first resistance layer is within the range of from $10^6$ to 10 Ω.cm, and the volume resistivity of the second resistance layer is within the range of from $10^9$ to $10^{12}$ Ω.cm.

8. The method of claim 7 wherein the volume resistivity of the second resistance layer is in the range of from $10^9$ to $10^{11}$ Ω.cm.

9. The method of claim 1 wherein the first resistance layer of the laminated flexible sheet has a thickness of from 50 to 400 μm and the second resistance layer has a thickness of from 15 to 100 μm.

10. The method of claim 1 wherein the first resistance layer of the laminated flexible sheet has a thickness of from 100 to 300 μm and the second resistance layer has a thickness of from 20 to 60 μm.

* * * * *